US009271533B2

(12) United States Patent
Kochling

(10) Patent No.: US 9,271,533 B2
(45) Date of Patent: Mar. 1, 2016

(54) POCKETED GARMENT

(76) Inventor: Edmund T. Kochling, Charlton, MA (US)

( * ) Notice: Subject to any disclaimer, the term of this patent is extended or adjusted under 35 U.S.C. 154(b) by 0 days.

(21) Appl. No.: 13/199,369

(22) Filed: Aug. 25, 2011

(65) Prior Publication Data

US 2012/0060260 A1 Mar. 15, 2012

Related U.S. Application Data

(60) Provisional application No. 61/402,181, filed on Aug. 25, 2010, provisional application No. 61/460,358, filed on Dec. 30, 2010.

(51) Int. Cl.
*A41D 27/20* (2006.01)

(52) U.S. Cl.
CPC ..... *A41D 27/205* (2013.01)

(58) Field of Classification Search
CPC ..... A41D 13/1236; A41B 1/00; A41B 27/20; A41B 47/205
USPC ..... 2/114, 83, 115, 249–250, 209, 244; 381/300, 301, 333, 388
See application file for complete search history.

(56) References Cited

U.S. PATENT DOCUMENTS

| | | | | | |
|---|---|---|---|---|---|
| 1,585,426 | A | * | 5/1926 | Simpson | 2/93 |
| 2,008,783 | A | * | 7/1935 | Marius | 2/115 |
| 2,383,746 | A | * | 8/1945 | Shapiro | 2/247 |
| 3,350,720 | A | | 11/1967 | Freund | |
| D233,707 | S | | 11/1974 | Jaramillo et al. | |
| D243,291 | S | | 2/1977 | Mechaly et al. | |
| D250,226 | S | | 11/1978 | Shaw | |
| D256,624 | S | | 9/1980 | Heinfling | |
| D257,409 | S | | 10/1980 | Kishbaugh et al. | |
| 4,876,724 | A | * | 10/1989 | Suzuki | 381/385 |
| 5,078,134 | A | * | 1/1992 | Heilman et al. | 607/4 |
| 5,257,420 | A | * | 11/1993 | Byrne, Jr. | 2/209 |
| D355,752 | S | | 2/1995 | Abbott | |
| 6,175,966 | B1 | * | 1/2001 | Wiesenthal | 2/247 |
| 6,818,816 | B2 | * | 11/2004 | Roberts et al. | 84/723 |
| 7,010,812 | B1 | * | 3/2006 | Cho et al. | 2/114 |
| 7,296,303 | B1 | | 11/2007 | Samet | |
| 7,519,192 | B1 | * | 4/2009 | Laycock et al. | 381/301 |
| D596,829 | S | | 7/2009 | Miller | |
| 7,673,348 | B2 | * | 3/2010 | Williams | 2/115 |
| D632,460 | S | | 2/2011 | Kinder | |
| D636,973 | S | | 5/2011 | Smith et al. | |
| 8,107,653 | B2 | * | 1/2012 | Wolfe | 381/301 |
| D655,478 | S | | 3/2012 | McCollum | |
| D659,350 | S | | 5/2012 | McDonnell | |

(Continued)

OTHER PUBLICATIONS

U.S. Appl. No. 29/373,272, inventor Edmund T. Kochling, filed Mar. 24, 2011.

(Continued)

*Primary Examiner* — Shaun R Hurley
*Assistant Examiner* — Andrew W Sutton
(74) *Attorney, Agent, or Firm* — Kriegsman & Kriegsman

(57) ABSTRACT

A pocketed garment dimensioned to cover at least a portion of a torso of a person. According to one embodiment, the garment is a shirt, and a pocket is positioned on the rear exterior of the shirt. The pocket includes a first opening for insertion of a portable entertainment device into the pocket. The pocket also includes a second opening through which headphone wires, connected to the portable entertainment device, may be passed.

20 Claims, 20 Drawing Sheets

(56) References Cited

U.S. PATENT DOCUMENTS

| | | | | |
|---|---|---|---|---|
| 8,312,568 | B2 * | 11/2012 | Marois et al. | 2/252 |
| 2001/0050991 | A1 * | 12/2001 | Eves | 381/11 |
| 2004/0083529 | A1 * | 5/2004 | Tate | 2/115 |
| 2007/0028346 | A1 * | 2/2007 | Williams | 2/69 |
| 2007/0245444 | A1 * | 10/2007 | Brink | 2/69 |
| 2008/0032600 | A1 | 2/2008 | Updyke | |
| 2008/0184459 | A1 * | 8/2008 | Barnes | 2/249 |
| 2009/0031474 | A1 * | 2/2009 | Komorowski | 2/114 |
| 2009/0094725 | A1 * | 4/2009 | Smith et al. | 2/69 |
| 2009/0235426 | A1 | 9/2009 | Johnston et al. | |
| 2009/0262967 | A1 * | 10/2009 | Bryan | 381/333 |
| 2009/0293170 | A1 * | 12/2009 | Kiker | 2/84 |
| 2010/0100997 | A1 * | 4/2010 | Lee et al. | 2/69 |
| 2010/0115684 | A1 * | 5/2010 | Freedman et al. | 2/128 |
| 2010/0329499 | A1 * | 12/2010 | Wolfe | 381/376 |
| 2011/0019861 | A1 * | 1/2011 | Wolfe | 381/384 |
| 2011/0129110 | A1 * | 6/2011 | Wolfe | 381/333 |
| 2012/0060260 | A1 * | 3/2012 | Kochling | 2/250 |
| 2012/0186000 | A1 | 7/2012 | Raviv | |
| 2012/0201412 | A1 * | 8/2012 | Del Prete | 381/374 |
| 2012/0272431 | A1 * | 11/2012 | Kupinic | 2/129 |

OTHER PUBLICATIONS

Run: Swiftly Tech Long Sleeve, [online], [retrieved on Sep. 25, 2012]. Retrieved from, <URL:http://shop.lululemon.com/products/clothes-accessories/run-swiftly/Run-Swiftly.

* cited by examiner

POCKETED GARMENT

CROSS-REFERENCE TO RELATED APPLICATIONS

The present application claims the benefit under 35 U.S.C. 119(e) of U.S. Provisional Patent Application No. 61/402,181, filed Aug. 25, 2010, and also claims the benefit under 35 U.S.C. 119(e) of U.S. Provisional Patent Application No. 61/460,358, filed Dec. 30, 2010, both of which are incorporated herein by reference.

BACKGROUND OF THE INVENTION

The present invention relates generally to garments and relates more particularly to garments having one or more pockets.

Portable entertainment devices of the type that output audio and/or video information are pervasive in today's society. Examples of such devices include, but are not limited to, MP3 players, CD players, audiotape players, cell phones, handheld video games, transistor radios, satellite radios, and the like. Such devices typically comprise a jack into which a headphone set may be plugged to permit the audio output from the device to be listened to privately by an individual wearing the headphones.

Many people like to walk, run, or otherwise be active physically while listening through headphones to a portable entertainment device of the type described above. To do so, many people place the portable entertainment device in a garment pocket, such as a pocket in a pair of pants. Other people use a specially-designed holder to secure the device to a part of a user's body, such as the user's upper arm. Still other people simply hold the device in one hand. However, one problem that is common to all of the above approaches is that the headphone wires connecting the earpieces of the headphone set to the portable entertainment device typically dangle from the user's body for much of the distance between the earpieces and the device. Consequently, it is not uncommon for the wires to become tangled with a user's arms and/or hands as the user moves about. As can readily be appreciated, such tangling of the wires with the user's limbs can impede the user's movements and may present a safety hazard to the user and/or to those in proximity to the user.

SUMMARY OF THE INVENTION

It is an object of the present invention to provide a novel garment.

It is another object of the present invention to provide a garment as described above that comprises a unique type of pocket.

It is still another object of the present invention to provide a garment as described above that is capable of overcoming at least some of the problems discussed above relating to headphone wires attached to a portable entertainment device.

According to one aspect of the invention, there is provided a garment dimensioned to cover at least a portion of a torso of a person, the garment comprising a pocket dimensioned to receive a portable electronic device and a sleeve dimensioned for passage of headphone wires therethrough, both the pocket and the sleeve being positioned on one of the exterior of the garment and the interior of the garment.

According to another aspect of the invention, there is provided a garment dimensioned to cover at least a portion of a torso of a person, the garment comprising a top end and a bottom end, the top end comprising a neck opening, the garment further comprising a first pocket, the first pocket comprising a first portion and a second portion, the first portion extending generally longitudinally in a direction between said top end and said bottom end, the second portion extending generally laterally relative to the first portion, the first portion having a first opening proximate to a top end thereof, the second portion having a second opening, the second opening communicating with the first opening through a passageway in said first pocket.

According to yet another aspect of the invention, there is provided a garment comprising (a) a clothing article dimensioned to cover at least a portion of a torso of a person; and (b) a sheet of material, the sheet of material secured to the clothing article to define a pocket, the pocket having a first opening, a second opening and a passageway connecting the first opening and the second opening.

The present invention is also directed at the combination of a garment of the type described above and a personal entertainment device attached through wires to a headphone set.

For purposes of the present specification and claims, various relational terms like "top," "bottom," "inner," "outer," "proximal," "distal," "upper," "lower," "front," and "rear" are used to describe the present invention when said invention is positioned in or viewed from a given orientation. It is to be understood that, by altering the orientation of the invention, certain relational terms may need to be adjusted accordingly.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. The drawings are not necessarily to scale, emphasis instead being placed upon illustrating the principles of the invention. In the drawings, wherein like reference numerals represent like parts, wherein dotted lines represent stitching for a garment pocket, and wherein dashed lines represent portions of a portable entertainment device and/or an attached set of headphones positioned within a garment pocket and obscured from view and/or represent portions of the garment pocket obscured from view.

DETAILED DESCRIPTION OF PREFERRED EMBODIMENTS

Figure 1:
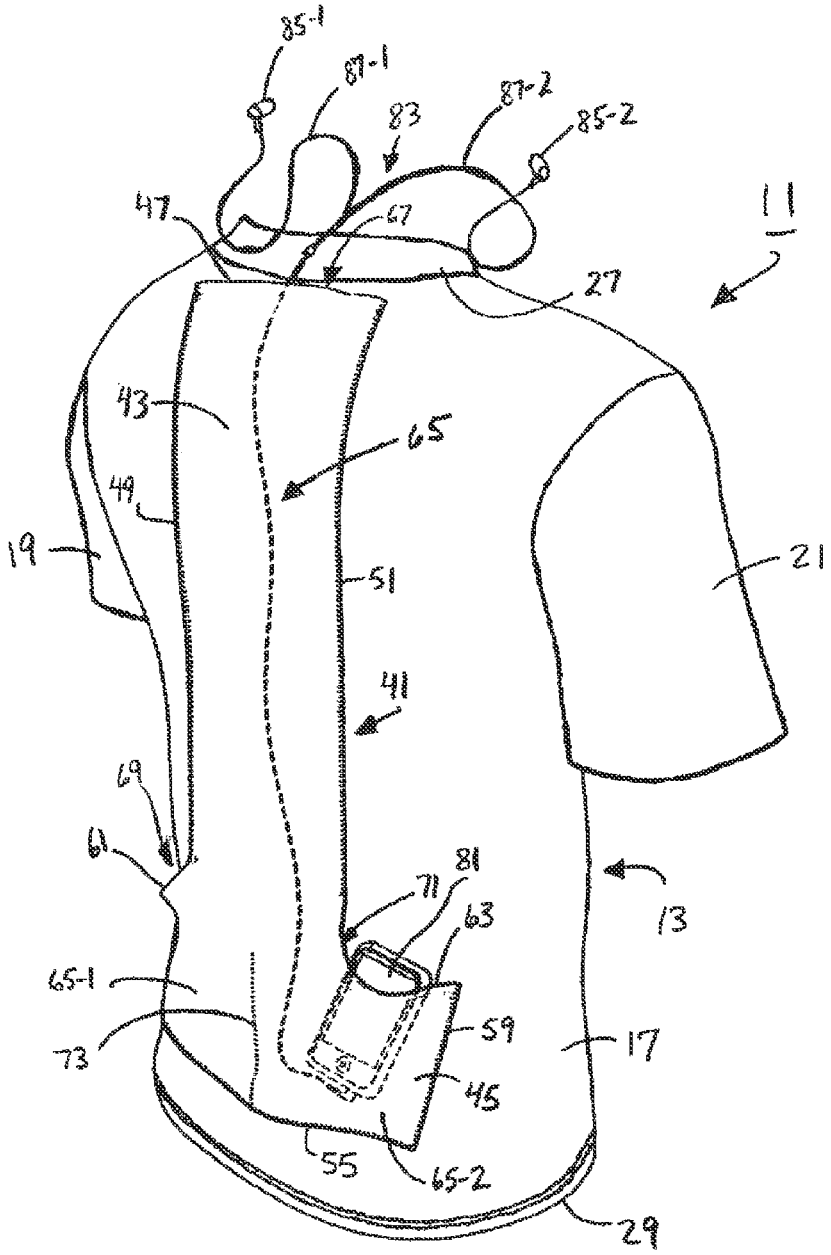
FIG. 1 is a rear perspective view of a first embodiment of a pocketed garment constructed according to the teachings of the present invention, the pocketed garment comprising a rear exterior pocket and being shown with a portable entertainment device inserted into the rear exterior pocket of the pocketed garment through a first opening in the rear exterior pocket and with headphone wires that are attached to the portable entertainment device extending through a second opening in the rear exterior pocket.
Figure 2:
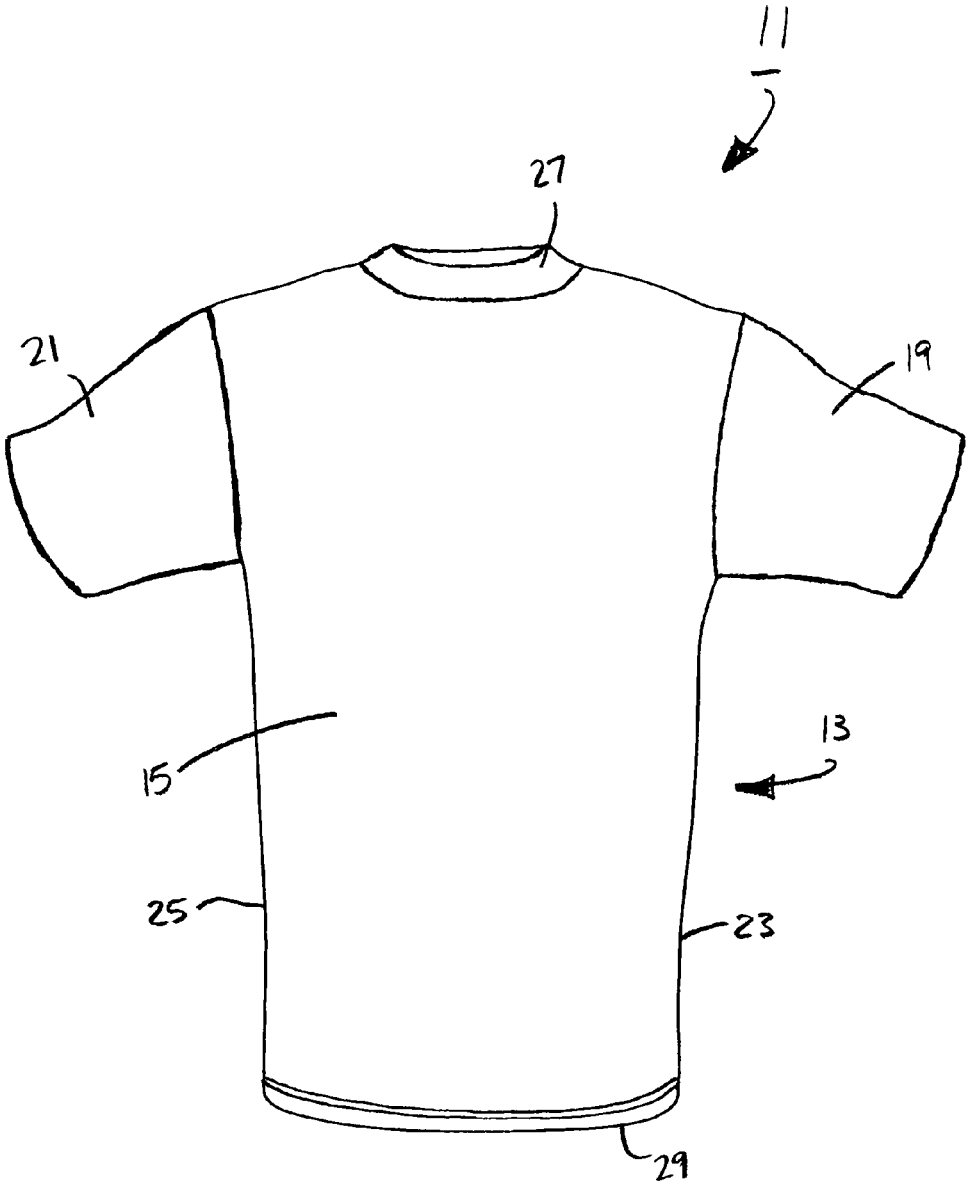
FIG. 2 is a front view of the pocketed garment shown in FIG. 1.
Figure 3:
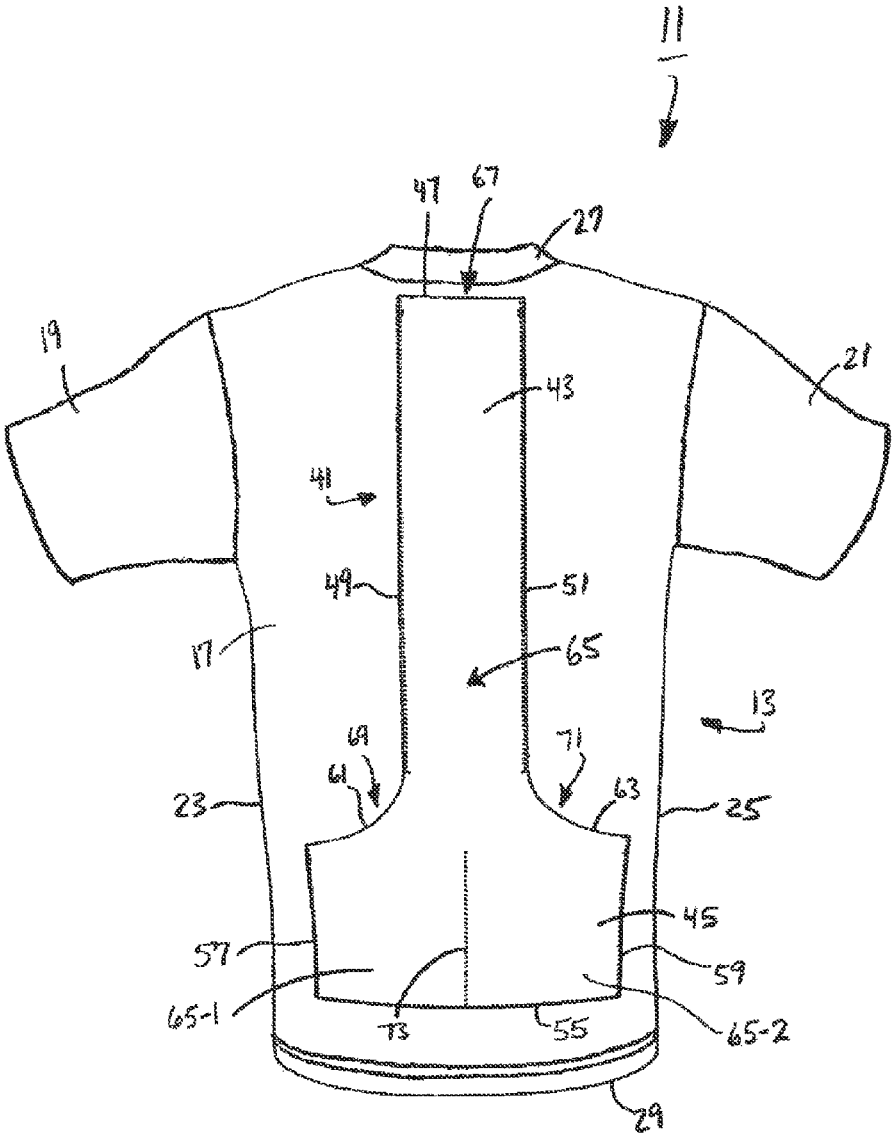
FIG. 3 is a rear view of the pocketed garment shown in FIG. 1.
Figure 4:
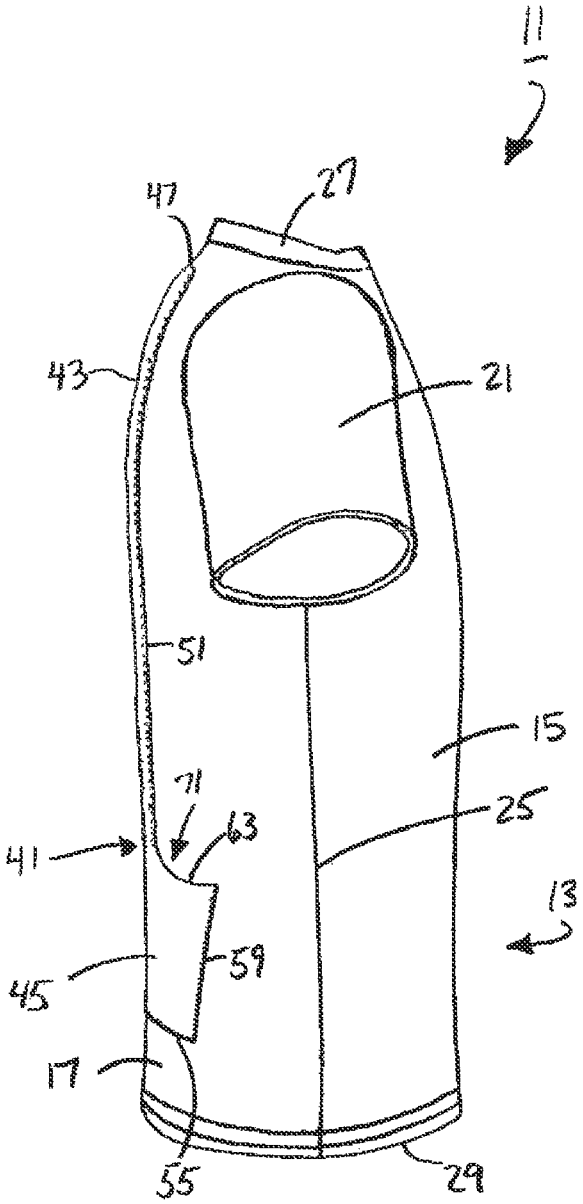
FIG. 4 is a right side view of the pocketed garment shown in FIG. 1, the left side view being a mirror image of the right side view.
Figure 5:
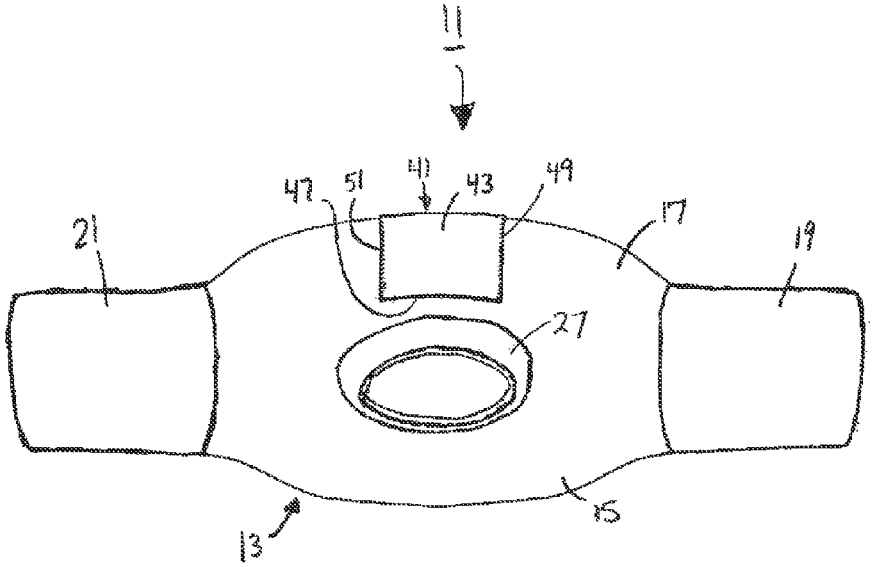
FIG. 5 is a top view of the pocketed garment shown in FIG. 1.
Figure 6:
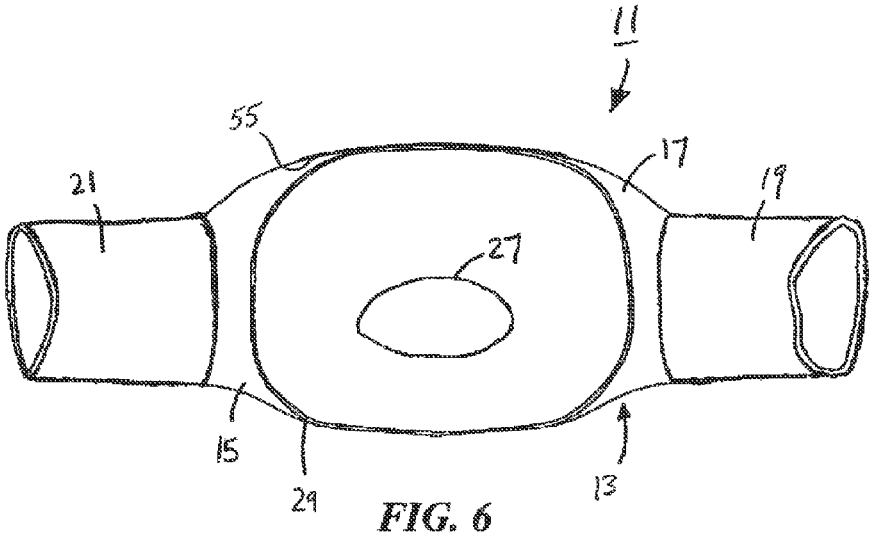
FIG. 6 is a bottom view of the pocketed garment shown in FIG. 1.
Figure 7:
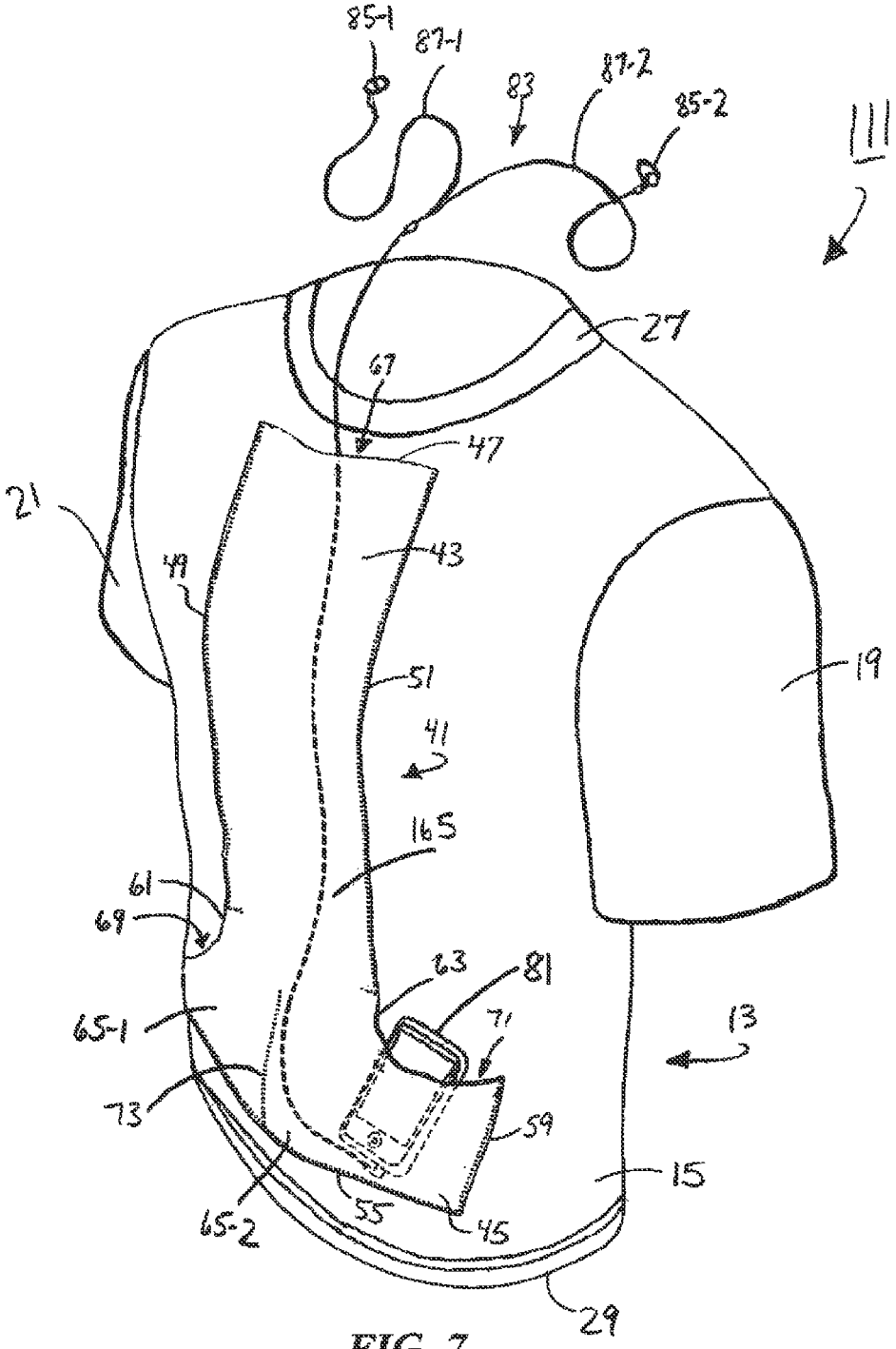
FIG. 7 is a front perspective view of a second embodiment of a pocketed garment constructed according to the teachings of the present invention, the pocketed garment comprising a front exterior pocket and being shown with a portable entertainment device inserted into the front exterior pocket of the pocketed garment through a first opening in the front exterior pocket and with headphone wires that are attached to the portable entertainment device extending through a second opening in the front exterior pocket.
Figure 8:
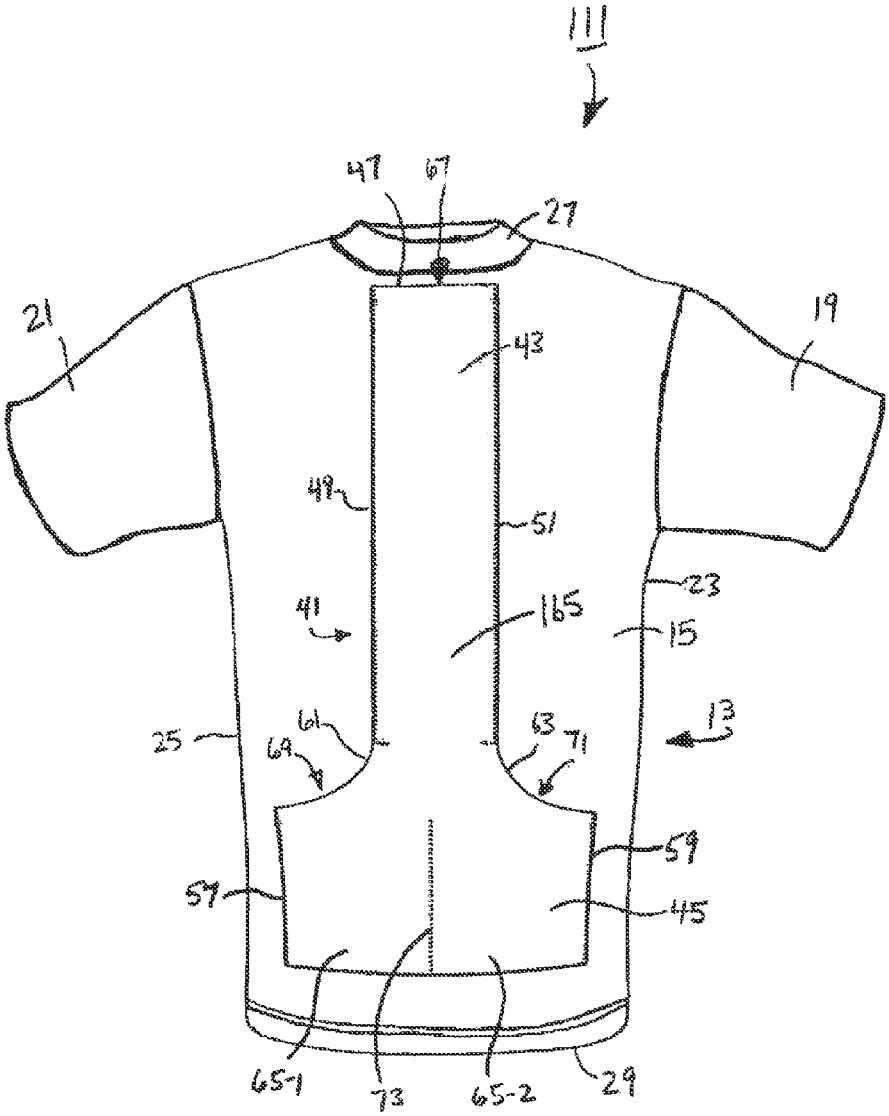
FIG. 8 is a front view of the pocketed garment shown in FIG. 7.
Figure 9:
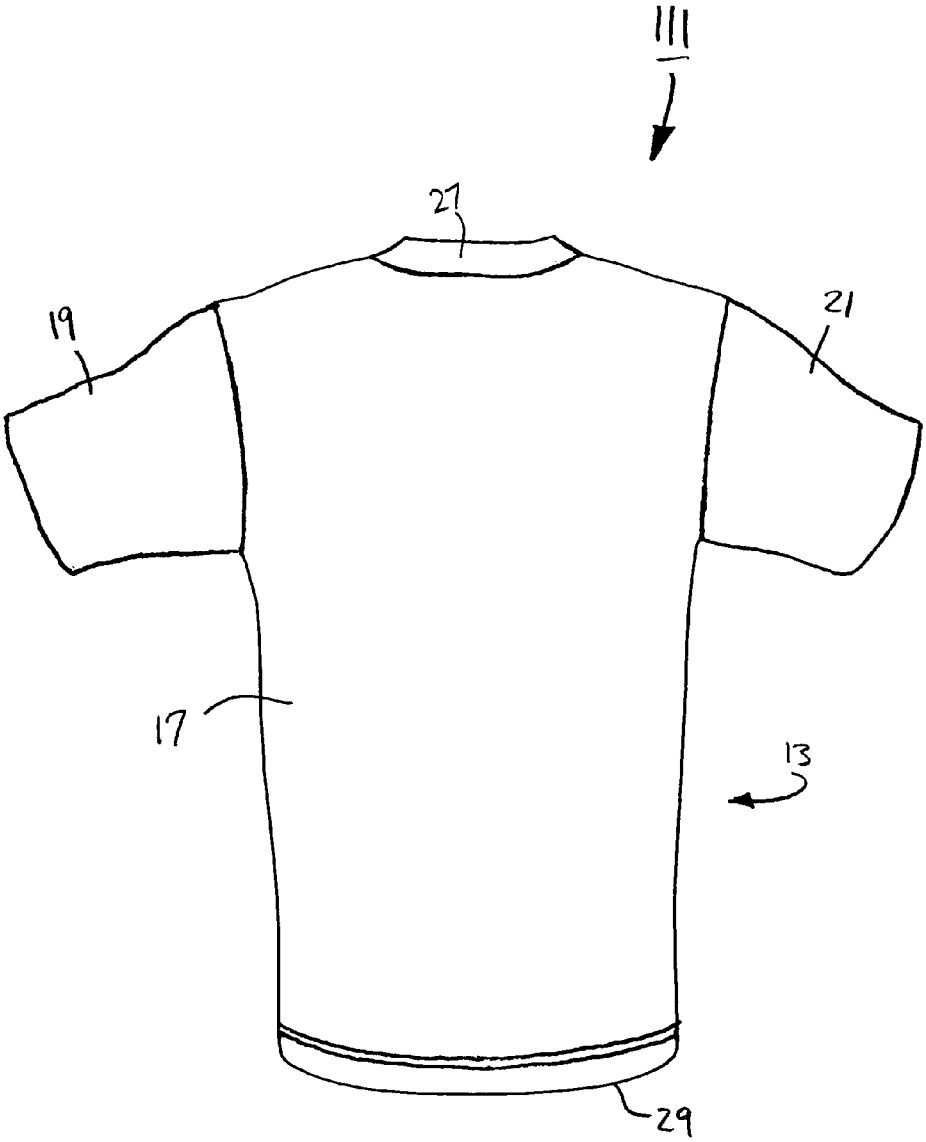
FIG. 9 is a rear view of the pocketed garment shown in FIG. 7.
Figure 10:
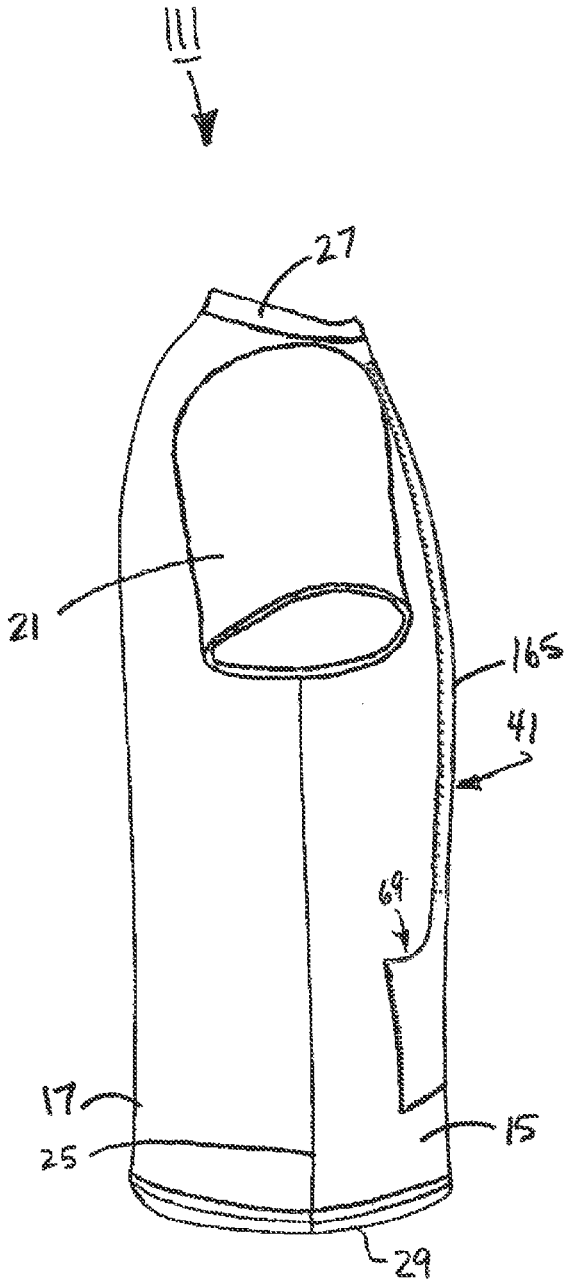
FIG. 10 is a right side view of the pocketed garment shown in FIG. 7, the left side view being a mirror image of the right side view.
Figure 11:
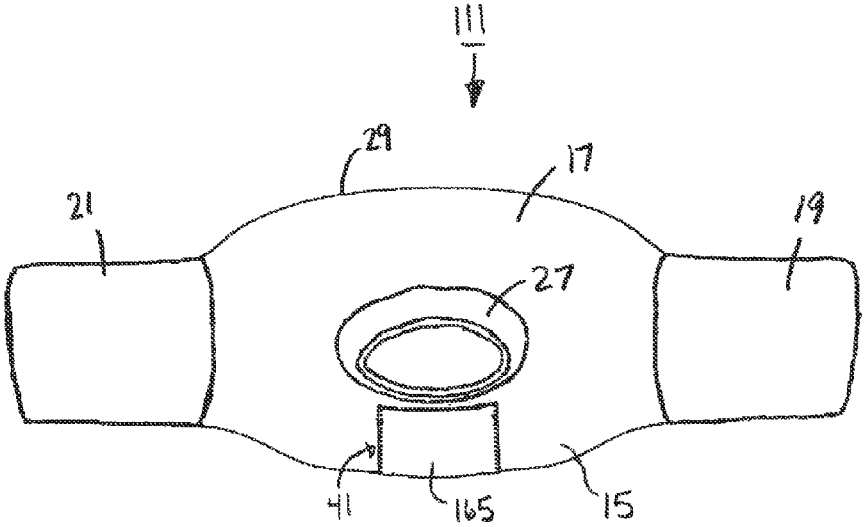
FIG. 11 is a top view of the pocketed garment shown in FIG. 7.
Figure 12:
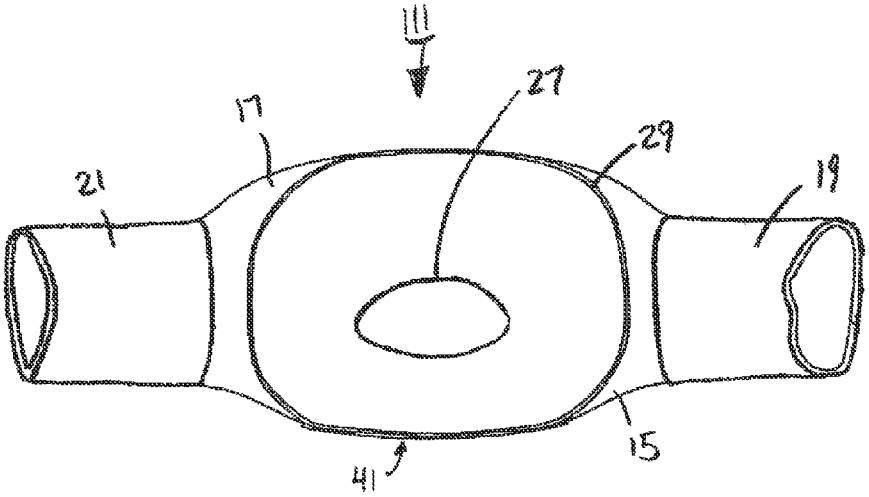
FIG. 12 is a bottom view of the pocketed garment shown in FIG. 7.
Figure 13:
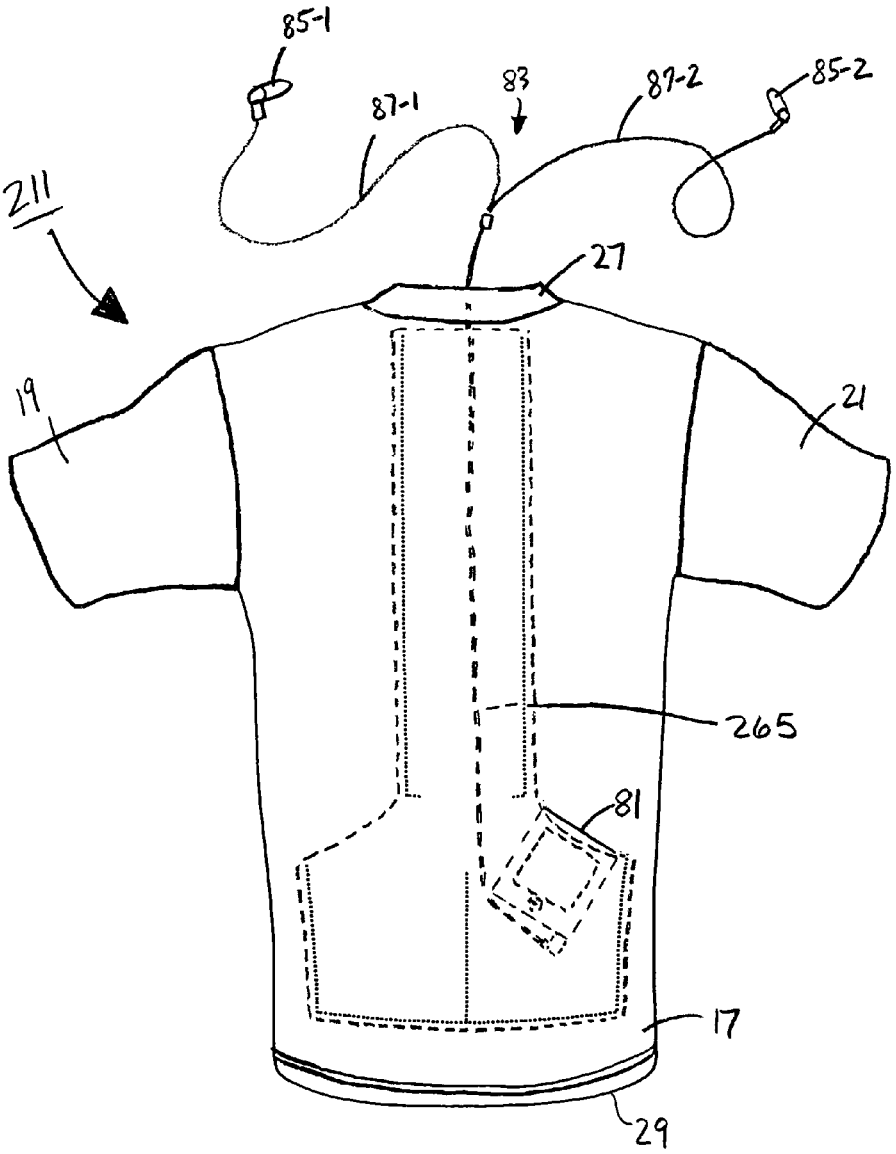
FIG. 13 is a rear view of a third embodiment of a pocketed garment constructed according to the teachings of the present invention, the pocketed garment comprising a rear interior pocket and being shown with a portable entertainment device inserted into the rear interior pocket of the pocketed garment through a first opening in the rear interior pocket and with headphone wires that are attached to the portable entertainment device extending through a second opening in the rear interior pocket.
Figure 14:
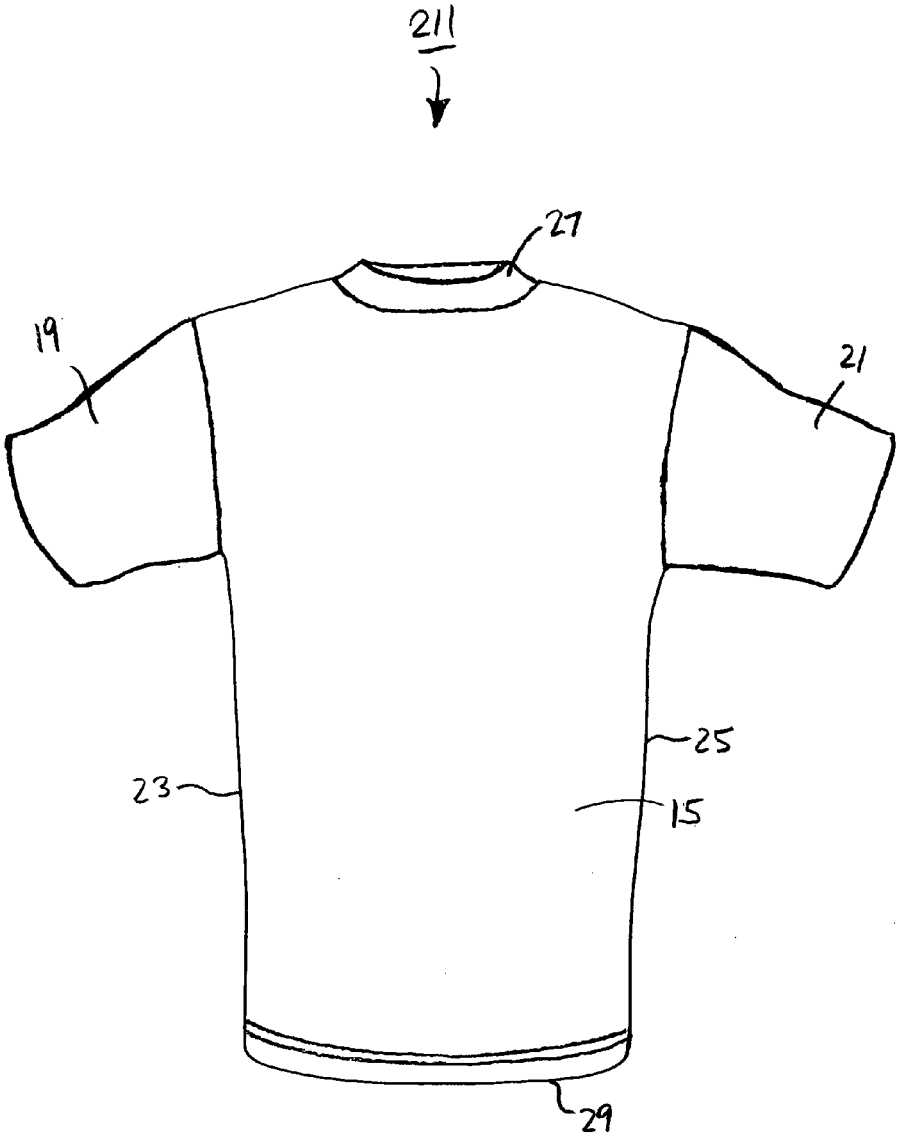
FIG. 14 is a front view of the pocketed garment shown in FIG. 13.
Figure 15:
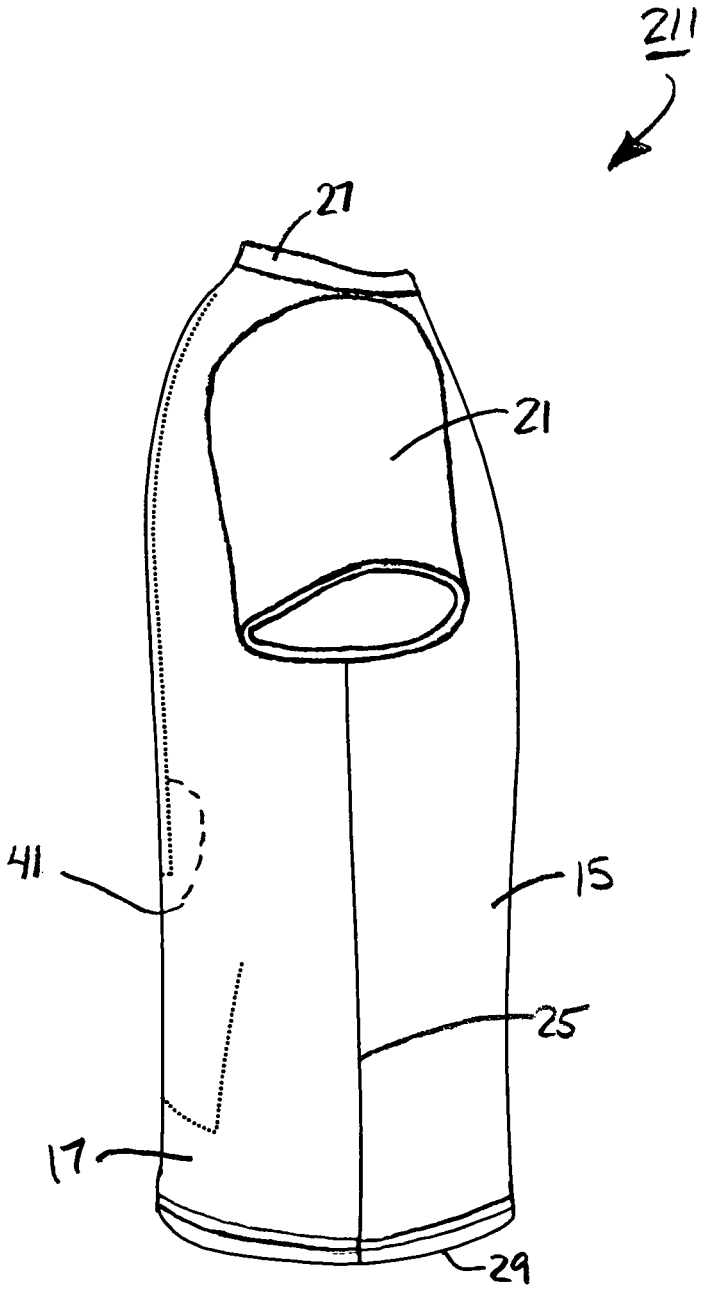
FIG. 15 is a right side view of the pocketed garment shown in FIG. 13, the left side view being a mirror image of the right side view.
Figure 16:
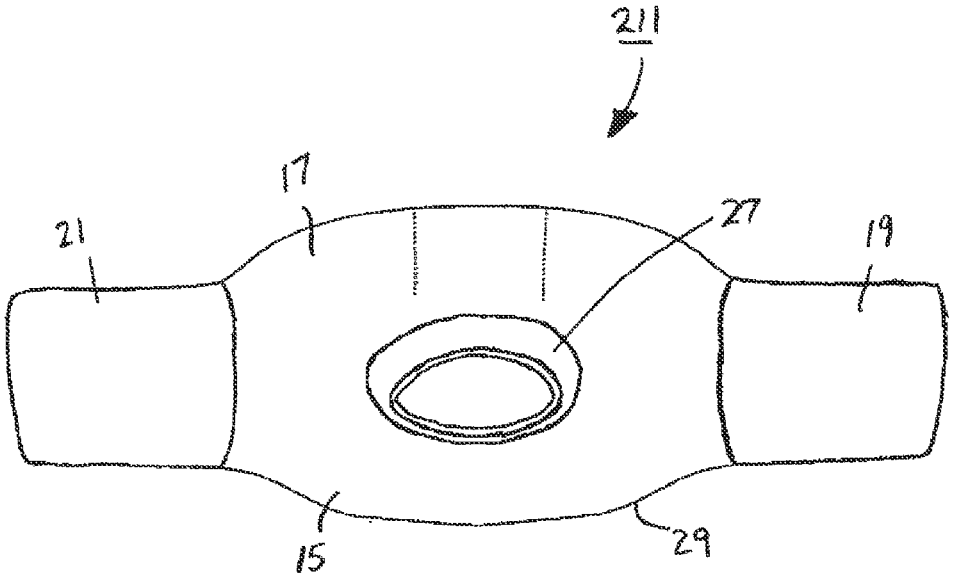
FIG. 16 is a top view of the pocketed garment shown in FIG. 13.
Figure 17:
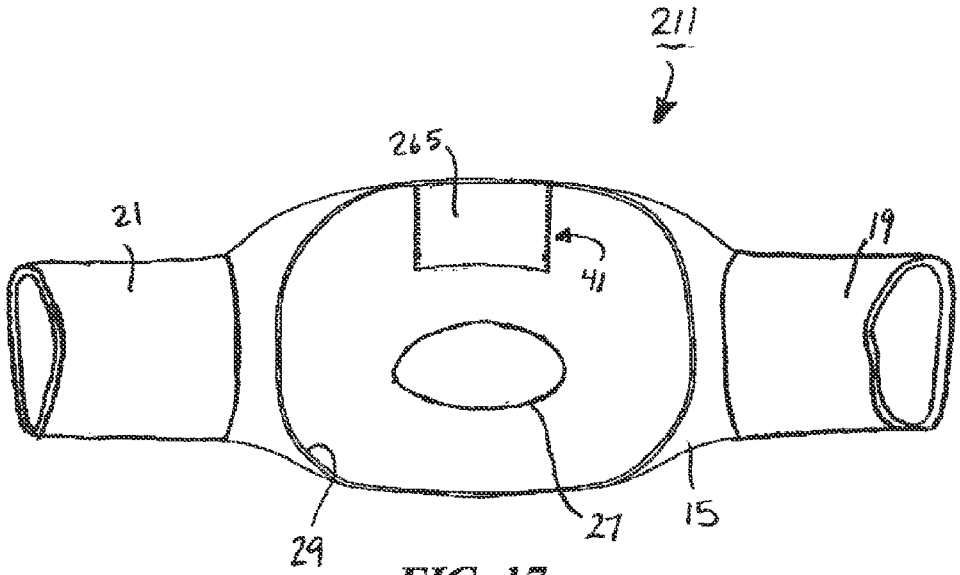
FIG. 17 is a bottom view of the pocketed garment shown in FIG. 13.
Figure 18:
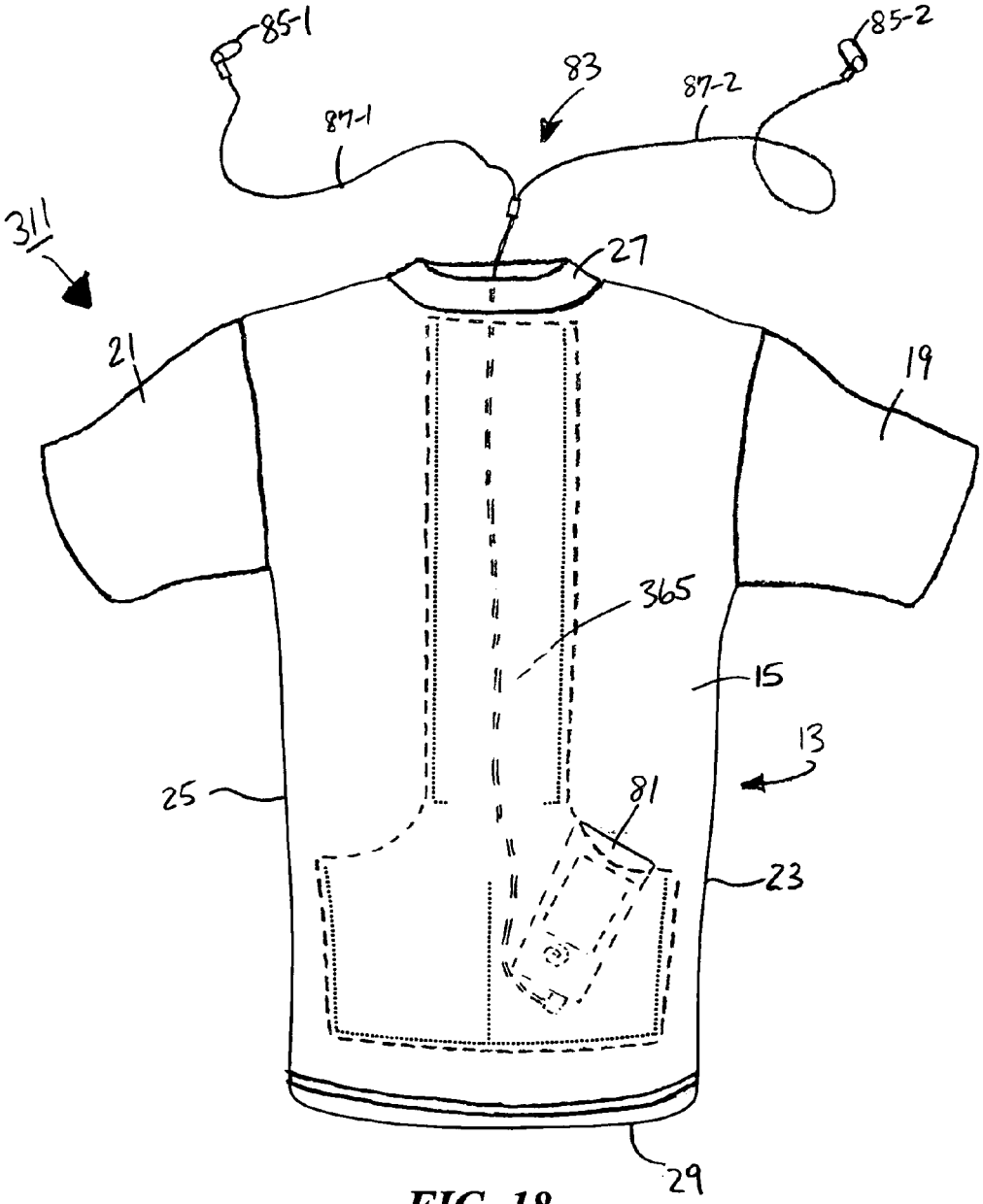
FIG. 18 is a front view of a fourth embodiment of a pocketed garment constructed according to the teachings of the present invention, the pocketed garment comprising a front interior pocket and being shown with a portable entertainment device inserted into the front interior pocket of the pocketed garment through a first opening in the front interior pocket and with headphone wires that are attached to the portable entertainment device extending through a second opening in the front interior pocket.
Figure 19:
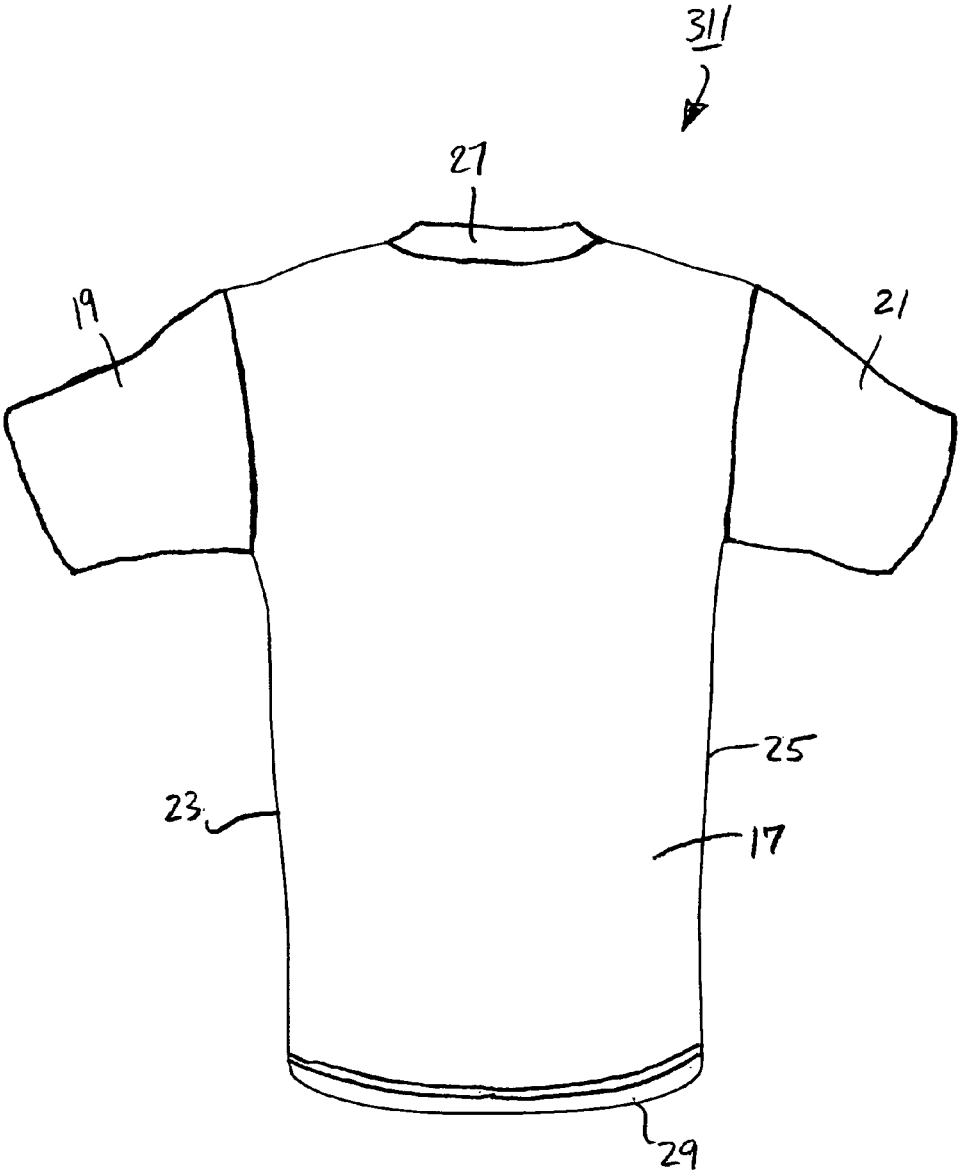
FIG. 19 is a rear view of the pocketed garment of FIG. 18.
Figure 20:
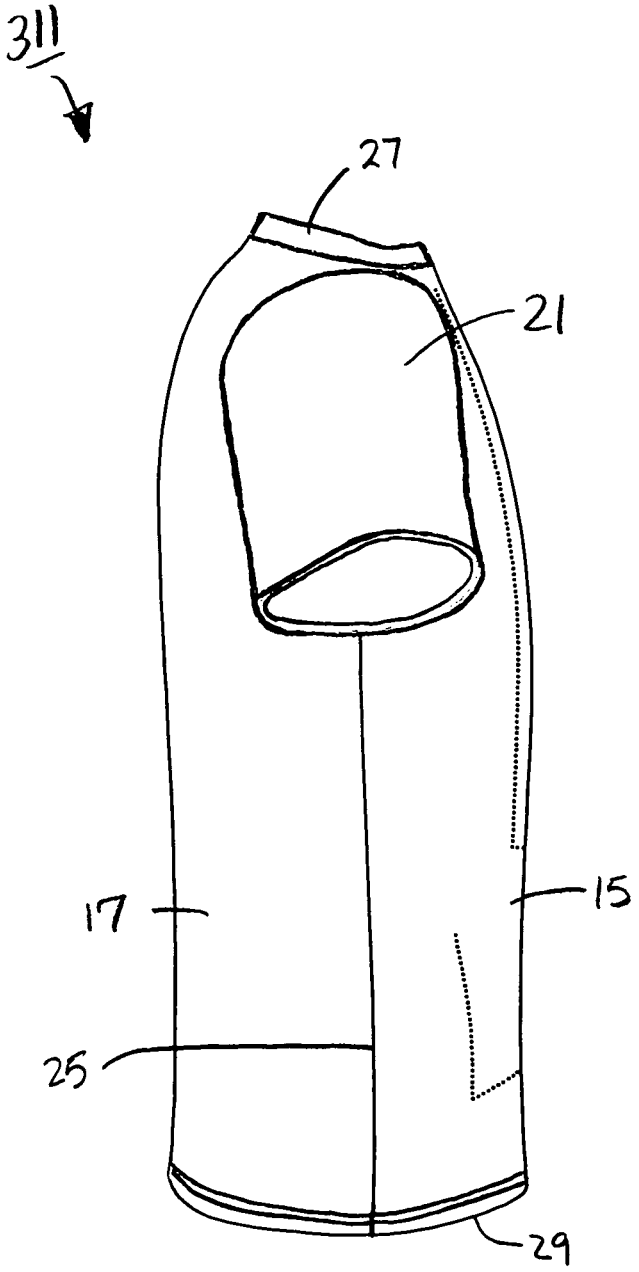
FIG. 20 is a right side view of the pocketed garment of FIG. 18, the left side view being a mirror image of the right side view.
Figure 21:
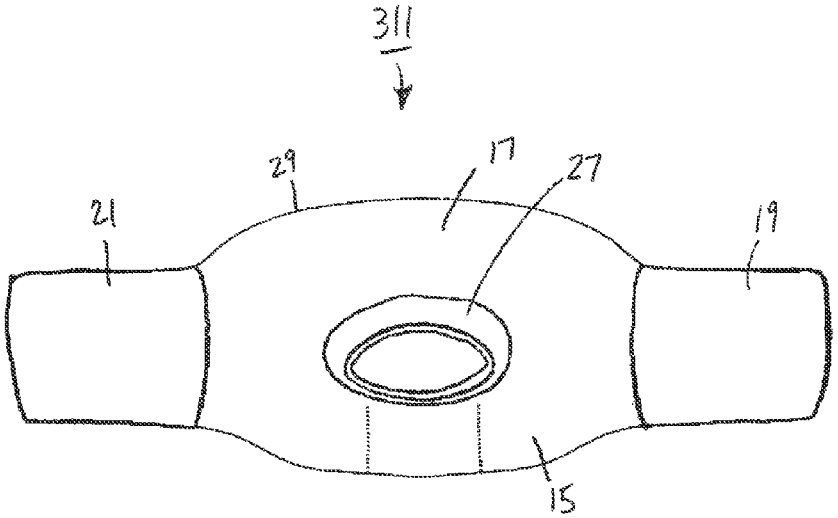
FIG. 21 is a top view of the pocketed garment of FIG. 18.
Figure 22:
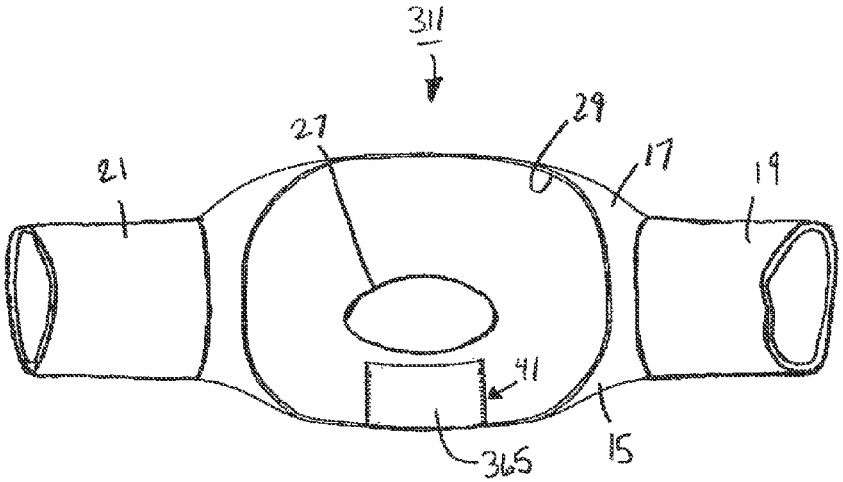
FIG. 22 is a bottom view of the pocketed garment of FIG. 18.

Referring now to FIGS. 1 through 6, there are shown various views of a first embodiment of a pocketed garment constructed according to the teachings of the present invention, the pocketed garment being represented generally by reference numeral 11. (For the sake of simplicity, certain components of garment 11 may not be shown in all views, and certain components of garment 11 unrelated to the present invention may not be shown or described herein.)

Garment 11 comprises a clothing article 13 of the type used to cover at least a portion of the torso of a person. In the embodiment shown, clothing article 13 is in the form of a short-sleeve shirt, such as a short-sleeve T-shirt; however, it should be understood that clothing article 13 is not limited to short-sleeve shirts and may comprise other types of shirts, such as, but not limited to, long-sleeve shirts and sleeveless shirts, as well as other types of clothing articles to be worn over at least a portion of the torso, such as, but not limited to, sweaters, sweatshirts, jackets, coats, nightshirts, pajamas, robes, bras, and the like.

Article 13 is shaped to include a chest portion 15, a back portion 17, a left sleeve 19 and a right sleeve 21. Chest portion 15 and back portion 17 are joined to one another with a left seam 23 and a right seam 25. A collar 27 for encircling a wearer's neck is joined to the respective top ends of portions 15 and 17. The respective bottom ends of portions 15 and 17 define a waist 29 for encircling a wearer's waist region.

Article 13 may be either woven or non-woven and may be made of natural materials, such as, but not limited to, cotton, leather and/or wool, or may be made of synthetic materials, such as, but not limited to, polyester and/or nylon, or may be made of semisynthetic materials, such as, but not limited to, rayon, or may be made of a combination of one or more of the foregoing materials.

Garment 11 additionally comprises a sheet of material 41, which, as will be discussed below, forms a pocket with article 13. Material 41, which is preferably made of the same type of material as article 13 (but need not be), has a generally inverted T-shape comprising an elongated first portion 43 and an elongated second portion 45, second portion 45 extending generally transversely relative to first portion 43. First portion 43 is positioned lengthwise so as to be centered along the exterior centerline of back portion 17 of article 13, with a top edge 47 of first portion 43 spaced just below collar 27 of article 13. First portion 43 is secured to back portion 17, preferably by stitching, along a left edge 49 and a right edge 51 of first portion 43, with top edge 47 not being secured to article 13. Second portion 45, which is positioned along the width of back portion 17 of article 13 and a short distance above waist 29, is secured to back portion 17, preferably by stitching, along a bottom edge 55, a left edge 57, and a right edge 59 of second portion 45, with the top left edge 61 and the top right edge 63 of second portion 45 not being secured to article 13. In this manner, sheet 41 and article 13 jointly define a unitary pocket 65 having a first opening 67 at top end 47 of first portion 43, a second opening 69 at top left edge 61 of second portion 45, and a third opening 71 at top right edge 63 of second portion 45. As shown in the present embodiment, pocket 65 may be partially divided into a left portion 65-1 and a right portion 65-2 by securing sheet 41 to article 13 with stitches 73.

As seen best in FIG. 1, garment 11 may be used in conjunction with a portable entertainment device 81 to which is attached a headphone set 83 comprising a pair of earpieces 85-1 and 85-2 connected by corresponding wires 87-1 and 87-2, respectively. According to one possible manner of use, portable entertainment device 81 may be inserted into pocket 65, for example, through opening 71. Wires 87-1 and 87-2 may extend from device 81 through pocket 65 and emerge through opening 67.

As can be appreciated, garment 11 enables a person to carry, in a hands-free manner, a portable entertainment device and, at the same time, keeps much of the length of the headphone wires against the body of the person and away from the moving limbs of the person, thereby reducing the likelihood that the wires may become tangled with the person as the person moves.

Referring now to FIGS. 7 through 12, there are shown various views of a second embodiment of a pocketed garment constructed according to the teachings of the present invention, the pocketed garment being represented generally by reference numeral 111. (For the sake of simplicity, certain components of garment 111 may not be shown in all views, and certain components of garment 111 unrelated to the present invention may not be shown or described herein.)

Garment 111 is similar in most respects to garment 11, the principal difference between the two garments being that, whereas sheet 41 is secured to the exterior of back portion 17 in garment 11 so as to form an exterior rear pocket 65, sheet 41 is secured to the exterior of chest portion 15 in garment 111 so as to form an exterior front pocket 165.

Garment 111 may be used in a similar manner to that discussed above for garment 11.

Referring now to FIGS. 13 through 17, there are shown various views of a third embodiment of a pocketed garment constructed according to the teachings of the present invention, the pocketed garment being represented generally by reference numeral 211. (For the sake of simplicity, certain components of garment 211 may not be shown in all views, and certain components of garment 211 unrelated to the present invention may not be shown or described herein.)

Garment 211 is similar in most respects to garment 11, the principal difference between the two garments being that, whereas sheet 41 is secured to the exterior of back portion 17 in garment 11 so as to form an exterior rear pocket 65, sheet 41 is secured to the interior of back portion 17 in garment 211 so as to form an interior back pocket 265.

Garment 211 may be used in a similar manner to that discussed above for garment 11.

Referring now to FIGS. 18 through 22, there are shown various views of a fourth embodiment of a pocketed garment constructed according to the teachings of the present invention, the pocketed garment being represented generally by reference numeral 311. (For the sake of simplicity, certain components of garment 311 may not be shown in all views, and certain components of garment 311 unrelated to the present invention may not be shown or described herein.)

Garment 311 is similar in most respects to garment 11, the principal difference between the two garments being that, whereas sheet 41 is secured to the exterior of back portion 17 in garment 11 so as to form an exterior rear pocket 65, sheet 41 is secured to the interior of chest portion 15 in garment 311 so as to form an interior front pocket 365.

Garment 311 may be used in a similar manner to that discussed above for garment 11.

Figure 23:
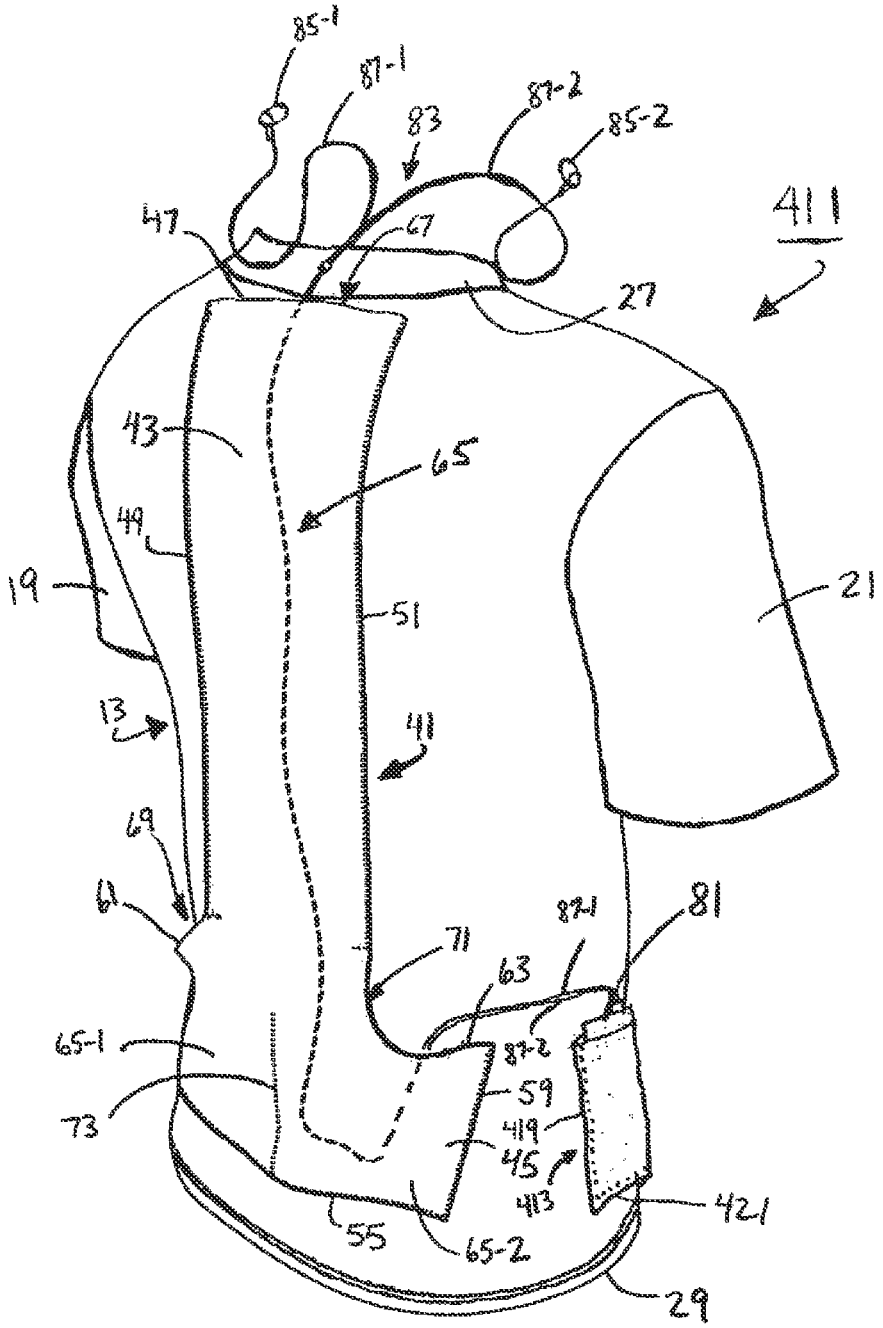
FIG. 23 is a rear perspective view of a fifth embodiment of a pocketed garment constructed according to the teachings of the present invention, the pocketed garment comprising a rear exterior pocket and a side exterior pocket and being shown with a portable entertainment device inserted into the side exterior pocket and with headphone wires that are attached to the portable entertainment device inserted through the rear exterior pocket.
Figure 24:
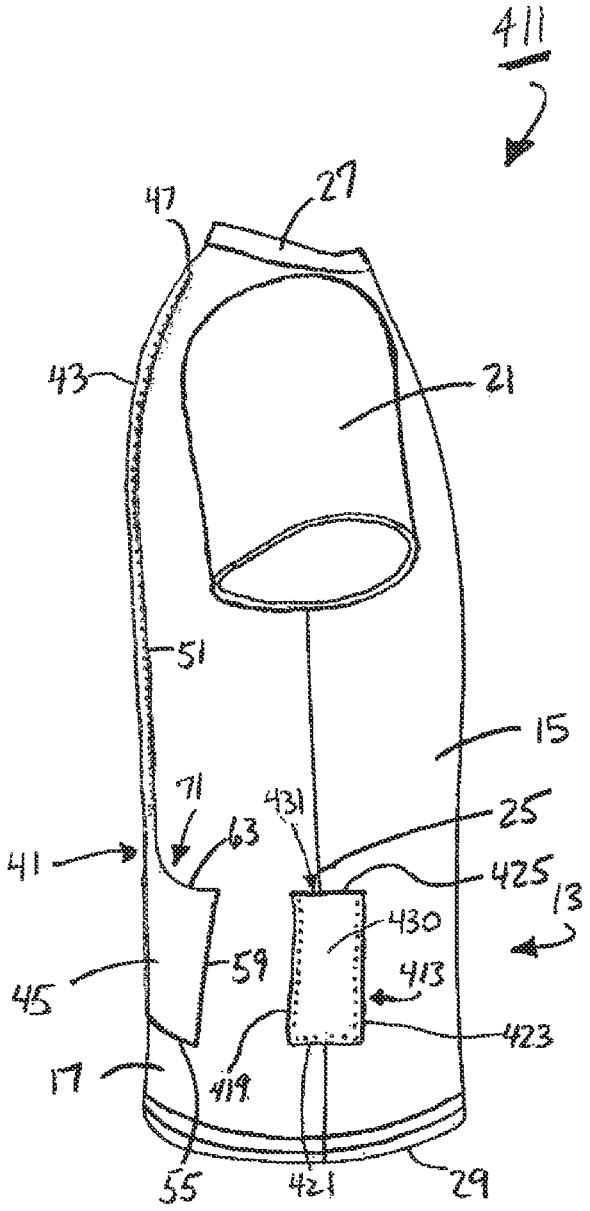
FIG. 24 is a right side view of the pocketed garment of FIG. 23.

Referring now to FIGS. 23 and 24, there are shown rear perspective and right side views, respectively, of a fifth embodiment of a pocketed garment constructed according to the teachings of the present invention, the pocketed garment being represented generally by reference numeral 411. (For the sake of simplicity, certain components of garment 411 may not be shown in all views, and certain components of garment 411 unrelated to the present invention may not be shown or described herein.)

Garment 411 is similar in most respects to garment 11, the principal difference between the two garments being that garment 411 additionally comprises a sheet of material 413. Sheet 413, which is preferably made of the same type of material as article 13 (but need not be), has a generally rectangular shape. Sheet 413 is positioned lengthwise so as to be centered along seam 25 of article 13 at approximately the same height as second portion 45 of sheet 41. Sheet 413 is secured to article 13, preferably by stitching, along a left edge 419, a bottom edge 421, and a right edge 423 of sheet 413, with top edge 425 of sheet 413 not being secured to article 13. In this manner, sheet 413 and article 13 jointly define a unitary pocket 430 having a top opening 431.

Garment 411 may be used in a similar manner to that discussed above for garment 11. Alternatively, as shown in FIG. 23, portable electronic device 81 may be positioned within pocket 430, with wires 87-1 being inserted into pocket 65 through opening 71 and then emerging from pocket 65 through opening 67. Positioning device 81 in pocket 430 in this manner may be advantageous as it may reduce the force that device 81 may exert on the back of article 13 while a person who is wearing garment 411 is engaged in running or a similar activity.

Although garments 11, 111, 211, 311, and 411 have been discussed herein primarily in the context of being used to carry portable entertainment devices and to constrain the movement of headphone wires, the garments of the present invention are not limited to this particular use, and the pockets disclosed herein may be used to receive any number of appropriately dimensioned and weighted objects. For example, garments having a rear pocket, such as garments 11, 211 and 411, may be used as an aid to inhibit snoring by receiving an object, such as a tennis ball, that would make sleeping on one's back uncomfortable for a wearer of the garment.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A garment dimensioned to cover at least a portion of a torso of a person, the garment comprising a torso covering portion, the torso covering portion comprising a top end and a bottom end, the top end comprising a neck opening, the garment further comprising a first pocket dimensioned to receive a portable electronic device and a sleeve dimensioned for passage of headphone wires therethrough, both the first pocket and the sleeve being positioned on one of the exterior of the torso covering portion of the garment and the interior of the torso covering portion of the garment, the first pocket and the sleeve forming a continuous passageway, wherein the first pocket and the sleeve are made from a single sheet of material secured to the torso covering portion of the garment, the single sheet of material having a generally inverted T-shape comprising an elongated first portion and an elongated second portion, the elongated first portion and the elongated second portion being generally perpendicular to one another, the elongated first portion extending in a direction between the top end and the bottom end and having a top edge spaced below the neck opening and further having a left edge and a right edge, the left edge and the right edge being secured along their respective entire lengths to the torso covering portion of the garment by stitching that passes through the left and right edges of the sleeve and the torso covering portion of the garment, the top edge of the elongated first portion not being secured to the torso covering portion of the garment, the elongated first portion and the torso covering portion of the garment jointly defining the sleeve, the elongated second portion being secured to the torso covering portion of the garment and jointly forming therewith the first pocket, the first pocket being partially divided into a left portion and a right portion, each of the left portion and the right portion having an opening dimensioned to receive the portable electronic device.

2. The garment as claimed in claim 1 wherein both the first pocket and the sleeve are positioned on the exterior of the torso covering portion of the garment.

3. The garment as claimed in claim 2 wherein both the first pocket and the sleeve are positioned on the front exterior of the torso covering portion of the garment.

4. The garment as claimed in claim 2 wherein both the first pocket and the sleeve are positioned on the rear exterior of the torso covering portion of the garment.

5. The garment as claimed in claim 2 further comprising a second pocket, wherein the second pocket is positioned on the side exterior of the torso covering portion of the garment and wherein the first pocket and the sleeve are positioned on the rear exterior of the torso covering portion of the garment.

6. The garment as claimed in claim 1 wherein both the first pocket and the sleeve are positioned on the interior of the torso covering portion of the garment.

7. The garment as claimed in claim 6 wherein both the first pocket and the sleeve are positioned on the front interior of the torso covering portion of the garment.

8. The garment as claimed in claim 6 wherein both the first pocket and the sleeve are positioned on the rear interior of the torso covering portion of the garment.

9. The garment as claimed in claim 1 wherein said garment is a shirt.

10. The garment as claimed in claim 9 wherein said garment is a short-sleeve shirt.

11. The combination of the garment of claim 1, a portable entertainment device, and a headphone set, the portable entertainment device being seated in the first pocket of the garment, the headphone set comprising a pair of earpieces and a pair of wires, each wire being connected at one end to a corresponding earpiece and at an opposite end to the portable entertainment device, the wires being inserted through the sleeve.

12. A garment, the garment comprising:

(a) a clothing article dimensioned to cover at least a portion of a torso of a person; and (b) a sheet of material, the sheet of material secured to the clothing article, the sheet of material having a generally inverted T-shape and comprising an elongated first portion and an elongated second portion, the elongated first portion and the elongated second portion being generally perpendicular to one another, the elongated first portion having a top edge, a left edge, and a right edge, the left edge and the right edge being secured along their respective entire lengths to the clothing article by stitching that passes through the left and right edges of the elongated first portion and the clothing article, the top edge of the elongated first portion not being secured to the clothing article, the elongated first portion and the clothing article jointly defining a sleeve having a first opening, the elongated second portion and the clothing article jointly defining a pocket, the pocket and the sleeve communicating with one another to provide a continuous passageway, the pocket being partially divided into a first portion and a second portion, the first portion having a second opening, the second portion having a third opening.

13. The garment as claimed in claim 12 wherein the sheet of material is located on the exterior of the clothing article.

14. The garment as claimed in claim 13 wherein the sheet of material is located on the rear of the clothing article.

15. The garment as claimed in claim 13 wherein the sheet of material is located on the front of the clothing article.

16. The garment as claimed in claim 12 wherein the sheet of material is located on the interior of the clothing article.

17. The garment as claimed in claim 16 wherein the sheet of material is located on the rear of the clothing article.

18. The garment as claimed in claim 16 wherein the sheet of material is located on the front of the clothing article.

19. The garment as claimed in claim 12 wherein the clothing article is a shirt.

20. The combination of the garment of claim 12, a portable entertainment device, and a headphone set, the portable entertainment device being seated in the pocket of the garment, the headphone set comprising a pair of earpieces and a pair of wires, each wire being connected at one end to a corresponding earpiece and at an opposite end to the portable entertainment device, the wires extending through the sleeve.

* * * * *